US010078943B2

(12) United States Patent
Feltham et al.

(10) Patent No.: US 10,078,943 B2
(45) Date of Patent: Sep. 18, 2018

(54) SYNCHRONIZATION OF NOTIFICATION PATTERNS IN ALERTING SYSTEMS

(71) Applicants: Robert Feltham, Fort Lauderdale, FL (US); Martin Chiarizio, Coral Springs, FL (US)

(72) Inventors: Robert Feltham, Fort Lauderdale, FL (US); Martin Chiarizio, Coral Springs, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/345,555

(22) Filed: Nov. 8, 2016

(65) Prior Publication Data

US 2018/0130315 A1 May 10, 2018

(51) Int. Cl.
*G08B 5/22* (2006.01)
*G08B 3/10* (2006.01)

(52) U.S. Cl.
CPC ..... *G08B 3/1016* (2013.01)

(58) Field of Classification Search
CPC ..... G08B 17/10; G08B 3/10; G08B 21/14; G08B 25/007; G08B 25/10; G08B 3/1016; H04L 12/1845; H04L 12/189; H04R 27/00; H04R 3/12
See application file for complete search history.

(56) References Cited

U.S. PATENT DOCUMENTS

2013/0120136 A1 5/2013 Johnson et al.
2016/0029346 A1* 1/2016 Suresh ..... H04W 72/005 340/539.16

FOREIGN PATENT DOCUMENTS

EP 2977971 1/2016
JP 2012100143 A * 5/2012

OTHER PUBLICATIONS

International Search Report and Written Opinion dated Jul. 11, 2017 for PCT/US2016/060883.

* cited by examiner

*Primary Examiner* — Brian Zimmerman
*Assistant Examiner* — Kevin Lau
(74) *Attorney, Agent, or Firm* — Fox Rothschild LLP; Robert J. Sacco; Carol E. Thorstad-Forsyth

(57) ABSTRACT

Method for synchronizing a non-symmetrical tonal pattern in a wireless alerting system involves receiving at a plurality of alerting devices a beacon message. The beacon message is used at the alerting devices to synchronously generate a synchronization pulse signal comprised of a plurality of synchronization pulses which are periodic in accordance with a predetermined synchronization pulse interval. A cadence section indicator (CSI) in the beacon message is used in combination with the synchronization pulse signal to determine a portion of an alarm cadence to sound at each of the alerting device so that the alarm cadence is synchronized among the plurality of the alerting devices.

19 Claims, 8 Drawing Sheets

SYNCHRONIZATION OF NOTIFICATION PATTERNS IN ALERTING SYSTEMS

BACKGROUND

Statement of the Technical Field

The technical field of this disclosure comprises alerting systems, and more particularly alerting systems that utilize cadence patterns which are other than a single repetitive event.

Description of the Related Art

Industrial, commercial and residential facilities commonly utilize electronic detection equipment for monitoring safety and security. Exemplary equipment of this type can detect the occurrence of smoke, heat and/or carbon monoxide as may occur in the case of fire or other hazards. In order to ensure that all parts of the facility are monitored, a plurality of detection units can be distributed at various locations throughout the facility. The detection units usually include one or more sensors and at least one type of notification unit. The notification unit is configured to generate an audible and/or visible alerting signal that is perceptible by humans so that when a hazardous condition is detected, the detectors can alert persons in the vicinity of the impending danger. Typical alerting signals can include audible tones, flashing lights and so on.

Alerting signals can involve a steady tone or a simple pulsed pattern in which the notification unit turns the audible and/or visible alerting signal on and off. But in more recent years, standards have been established involving temporal alarm patterns which are intended to communicate by virtue of the pattern certain information about the nature of the hazard that has been detected. For example, a standard evacuation pattern includes a conventional Temporal-Three alarm (T3) comprised of an interrupted four count (three half second pulses, followed by a one and one half second pause, repeated continuously for the duration of the alarm condition or until silenced by an authorized user. Another type of temporal pattern, which is specified for use upon detection of carbon monoxide, is Temporal-Four (T4). The T4 pattern consists of four 100 mS duration pulses, each spaced apart by 100 mS, followed by a five-second silent period, that repeats continuously for a period of four minutes and then once a minute for the duration of the alarm condition or until silenced by an authorized user.

SUMMARY

Embodiments concern a method for synchronizing a non-symmetrical tonal pattern in a wireless alerting system. The method involves concurrently receiving at a plurality of alerting devices a beacon message that is wirelessly broadcast by a parent device of the alerting devices during each of a plurality of time slots defined by a communication protocol. The beacon message is used at each of the plurality of alerting devices to synchronously generate a synchronization pulse signal comprised of a plurality of synchronization pulses which are periodic in accordance with a predetermined synchronization pulse interval. A cadence section indicator (CSI) specifying a value is received by the plurality of alerting devices as part of the beacon message. Each of the alerting devices uses the value specified by the CSI in combination with the synchronization pulse signal to determine a portion of an alarm cadence to sound at each of the alerting device so that the alarm cadence is synchronized among the plurality of the alerting devices.

The embodiments also include a wireless alerting device. The device includes a wireless receiver and a processing device. The wireless receiver is configured to receive a beacon message that is wirelessly broadcast by a parent device during each of a plurality of time slots defined by a communication protocol. The processing device uses the beacon message to synchronously generate a synchronization pulse signal. The synchronization pulse signal is comprised of a plurality of synchronization pulses which are periodic in accordance with a predetermined synchronization pulse interval. The processing device also parses the beacon message to determine a cadence section indicator (CSI) contained therein specifying a value. The value specified by the CSI is used by the processor in combination with the synchronization pulse signal to determine a portion of an alarm cadence to sound at the wireless alerting device so that the alarm cadence is synchronized with an alarm cadence sounded in at least a second alerting devices which also receives the beacon message. The embodiments further include a wireless alerting system comprised of a plurality of the alerting devices which operate as described to synchronously generate an alarm cadence.

BRIEF DESCRIPTION OF THE DRAWINGS

Embodiments will be described with reference to the following drawing figures, in which like numerals represent like items throughout the figures, and in which.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Embodiments disclosed herein concern hazard detection and alerting equipment which utilize temporal patterns comprising a time varying duty cycle during which the alarm signal is active. Temporal alarm patterns are advantageously synchronized using a combination of techniques which allow nearby alerting devices to quickly initiate alarms. Embodiments are particularly applicable to alerting equipment that utilize temporal patterns which are relatively long in duration such that it may be impractical to simply wait until a time marking the beginning of the next temporal pattern cycle. Further embodiments disclosed may be advantageous for use in relation to certain types of wireless detection and alerting equipment.

Figure 1:
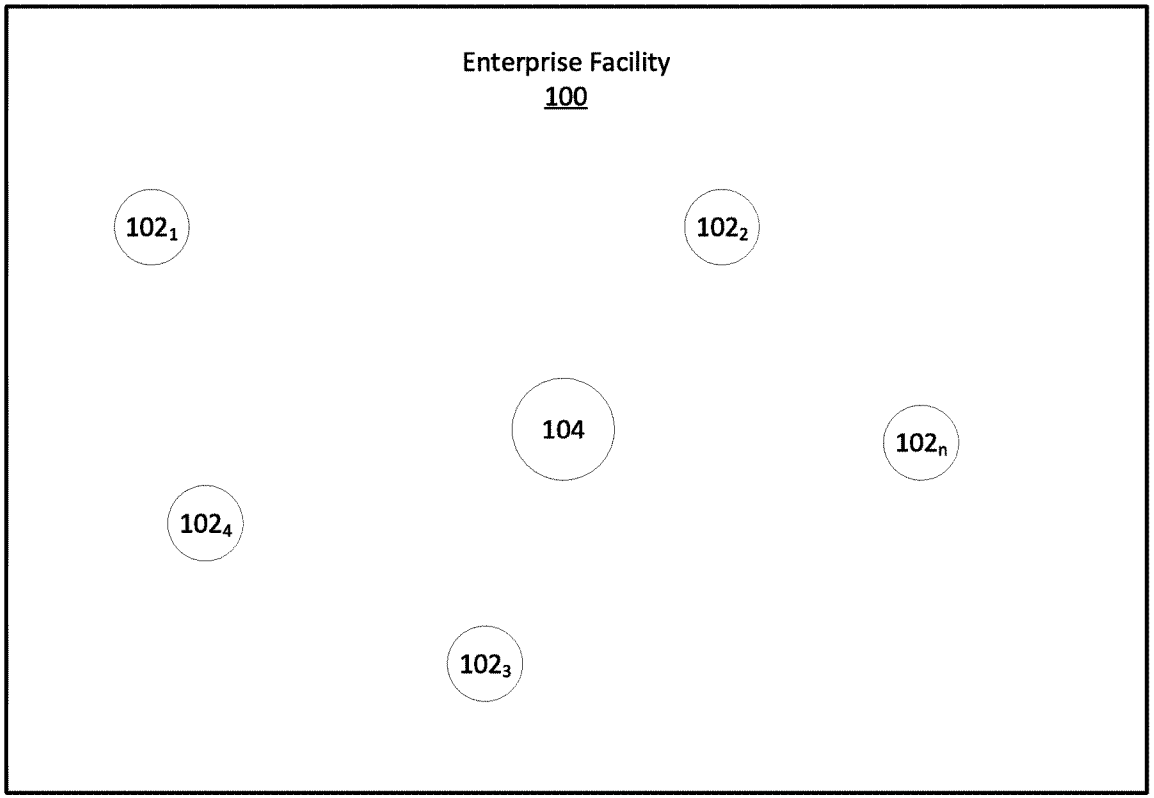
FIG. 1 is a block diagram which is useful for understanding an arrangement of a plurality of alerting devices which are distributed in various locations throughout an enterprise facility.

Referring now to FIG. 1 it can be observed that an enterprise facility 100 can comprise a commercial office space or other type of industrial facility in which a plurality of alerting devices $\mathbf{102}_1$, $\mathbf{102}_2$, $\mathbf{102}_3$, $\mathbf{102}_4$, . . . $\mathbf{102}_n$ are provided. The alerting devices can be installed at various distributed locations around the facility 100 so as to ensure that all areas are adequately monitored. The nature of the hazard that is monitored by the alerting devices is not critical for purposes of the embodiments disclosed herein. However, it will be appreciated that exemplary hazards which can be detected by such devices can include smoke and heat at would be generated in the case of a fire. The devices can also be configured to monitor for the presence of dangerous gasses, such as carbon monoxide. Of course, the embodiments are not limited in this regard and other conditions can also be monitored without limitation.

A parent device 104 supervises the operation of the alerting devices $\mathbf{102}_1$, . . . $\mathbf{102}_n$. The supervision operations involve wireless communications between the parent device and each of the alerting devices $\mathbf{102}_1$, . . . $\mathbf{102}_n$ according to a predetermined wireless communication protocol. In an embodiment, these communications are conducted in accordance with a frequency hopping spread spectrum protocol. For example, these communications can be conducted in the 902-928 MHz range of the Industrial, Scientific, and Medical (ISM) band.

Figure 2:
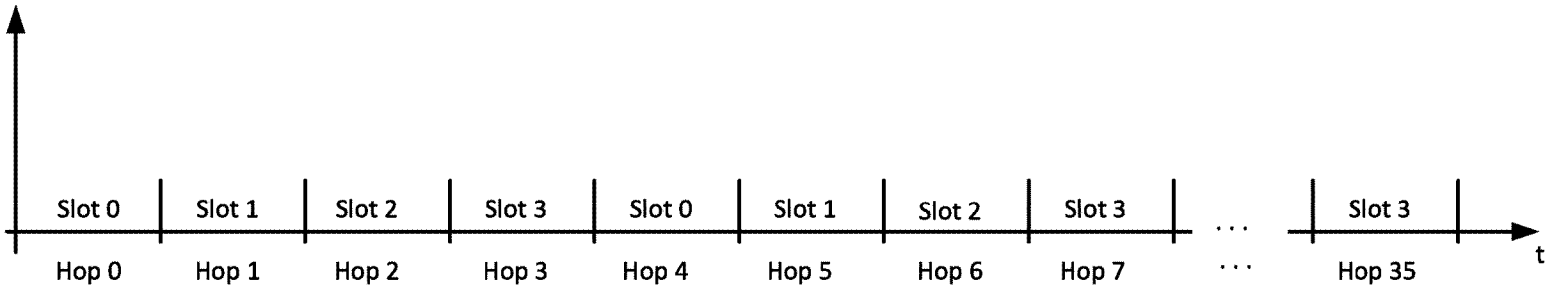
FIG. 2 is a timing diagram that is useful for understanding a communication protocol

As is known, low power wireless telemetry is permitted in this frequency range of the ISM band, but it is limited to frequency hopping spread spectrum and digitally modulated schemes in operating within certain defined parameters. In the United States, regulations specify the use of between 25 to 50 frequency hop channels, and a dwell time on each frequency hop channel not exceeding 400 ms. This concept is illustrated in FIG. 2 which shows a scenario in which a system (e.g. the system shown in FIG. 1) uses 36 frequency hop channels (Hop 0 . . . Hop 35) in accordance with a predetermined pseudorandom hopping sequence. It may be observed in FIG. 2 that the frequency hops can be assigned so as to correspond to time slots. In the example shown, there are four defined time slots (Slot 0 . . . Slot 3) which are periodically repeated in correspondence to the hop sequence. Still, it should be understood that the embodiments are limited to a system that uses four (4) slots. More or fewer slots are also possible in various systems depending on the system configuration. Accordingly, the examples of timing, channels, hop counts and so on as disclosed herein are merely provided as one possible example for purposes of explanation and should not be understood as limiting the scope of the various embodiments.

Figure 3:
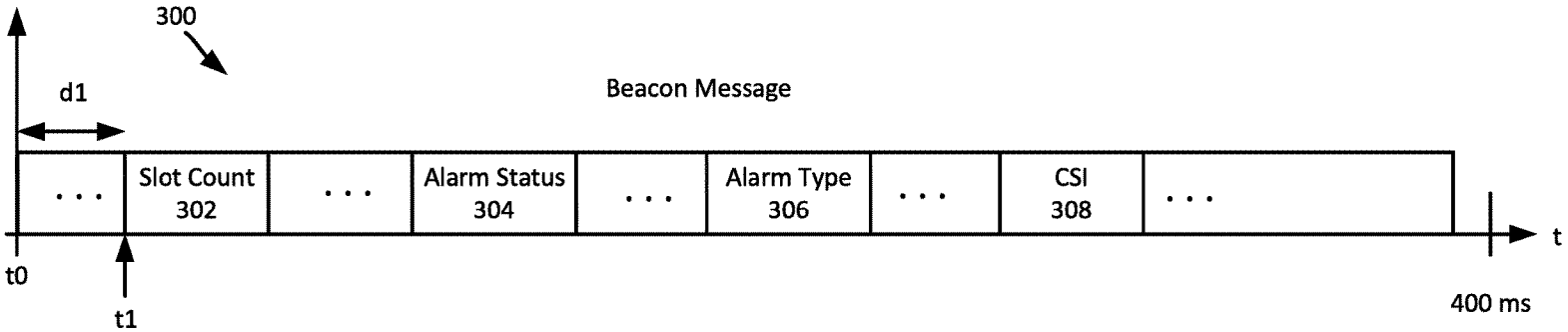
FIG. 3 is a diagram which is useful for understanding a beacon message format which can be used to implement synchronization methods described herein.

In the embodiment shown in FIG. 1, the parent device 104 wirelessly broadcasts a beacon message during a transmit time within each of the time slots (e.g., Slot 0 . . . Slot 3) to facilitate certain control functions with respect to the operation of the alerting devices $\mathbf{102}_1$, . . . $\mathbf{102}_n$. An exemplary beacon signal 300 for this purpose is shown in FIG. 3. A similar beacon message would be wirelessly transmitted during each of the slots (e.g., Slot 0 . . . Slot 3). A portion of one or more of the slots can also be utilized by the alerting devices $\mathbf{102}_1$, . . . $\mathbf{102}_n$. This time period can be used to report to the parent device that a particular alerting device is operational and/or has detected a hazard requiring activation of an alarm.

The beacon message 300 transmitted by the parent device can be comprised of a plurality of bytes of data, which are used to specify certain predetermined data or information which is to be communicated from the parent device 104 to the various alerting devices $\mathbf{102}_1$, . . . $\mathbf{102}_n$. In an embodiment disclosed herein, each beacon message can include information specifying a slot count 302 and an alarm status 304. The value of the slot count 302 indicates the time slot (e.g. Slot 0 . . . Slot 3) during which the beacon signal is being transmitted.

The alarm status 304 can specify whether a condition has been detected which requires the alerting devices $\mathbf{102}_1$, . . . $\mathbf{102}_n$ to activate a notifying device such as a horn or strobe lamp. The parent device 104 can be informed of an alarm condition by various means. For example, one or more of the alerting devices $\mathbf{102}_1$, . . . $\mathbf{102}_n$ can communicate with the parent device 104 during a predetermined part of a time slot to indicate that a hazardous condition has been detected. Alternatively, the parent device can be notified of such condition directly or indirectly by means of a communication from a remote central station (not shown). Once notified that a hazardous condition has been detected, the parent device 104 will use the alarm status 304 to communicate to the alerting devices $\mathbf{102}_1$, . . . $\mathbf{102}_n$ that they should activate their audible and/or visible notification units.

The beacon message 300 can also specify an alarm type. In the event that a hazardous condition is detected, the alerting devices $\mathbf{102}_1$, . . . $\mathbf{102}_n$ can generate audible and/or visible alerting signal that is perceptible by humans so that when a hazardous condition is detected, the detectors can alert persons in the vicinity of the impending danger. Typical alerting signals can include audible tones, flashing lights and so on. Alerting signals can involve a pulsed pattern in which the notification unit turns the audible and/or visible alerting signal on and off in accordance with a predetermined cadence or pattern. Accordingly, the alarm type 306 can specify the type of audible and/or visible alarm corresponding to a particular pattern that is to be generated by an audible or visible notification unit at each alerting device $\mathbf{102}_1$, . . . $\mathbf{102}_n$.

The beacon message 300 is broadcast continuously by the parent device 104. But in order to minimize power consumption, the alerting devices $\mathbf{102}_1$, . . . $\mathbf{102}_n$ will operate in a sleep mode for relatively long time periods and only wake up periodically (e.g. every 1.6 seconds) to listen for the beacon message. The alerting devices $\mathbf{102}_1$, . . . $\mathbf{102}_n$ operate asynchronously in this regard and therefore will wake up to listen for the beacon message at different times. The alerting devices use the beacon message to determine which of the slots the device woke up on, (e.g., Slot 1, Slot 2, Slot 3, or Slot 4). The alerting devices can also transmit a message at long intervals (e.g., every 90 seconds) to notify the parent device that the alerting device is active and operational.

By using information concerning the value specified for the slot count 302 and the known structure of the beacon message, each of the alerting devices $\mathbf{102}_1, \ldots \mathbf{102}_n$ can derive an internal synchronization pulse to help coordinate a timing of certain operations occurring at each alerting device. The synchronization pulse which is generated in each device will be synchronous will all other alerting devices $\mathbf{102}_1, \ldots \mathbf{102}_n$ which receive the same beacon message 300. For example, such synchronization pulse can be derived based on a slot count value and a time when one or more bits associated with the slot count 302 is/are received by each alerting device.

Figure 4:
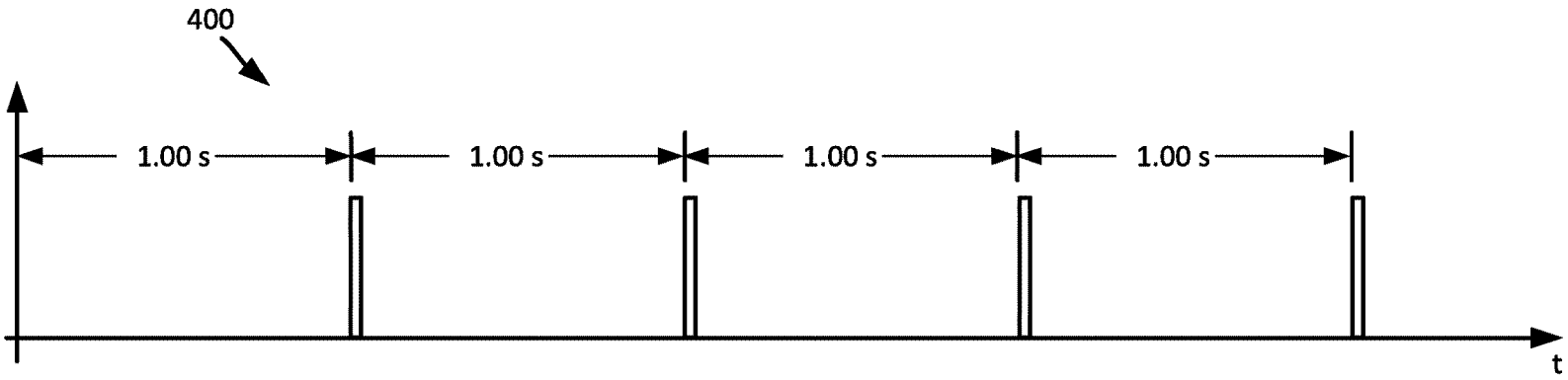
FIG. 4 is a timing diagram that is useful for understanding a series of synchronization pulses which are generated by an alerting device.

As an example, assume that the beacon message begins at time t0. It is known that the first bit of the slot count occurs a time t1 which occurs a time duration dl after the beginning of the beacon message at time t0. Using the foregoing, each of the alerting devices $\mathbf{102}_1, \ldots \mathbf{102}_n$ which receive the beacon message can determine the beginning time t0 of time slot 300. The foregoing information can be used by each alerting device $\mathbf{102}_1 \ldots \mathbf{102}_n$ to generate an internal synchronization pulse at a predetermined interval, such as every 1.00 seconds. Since the data transmission rate is known and the position of the slot count data in the message beacon is known, once the slot count data is received the offset from an arbitrary synchronization point can be calculated. Such a scenario is illustrated in FIG. 4, which shows a plurality of synchronization pulses 400 aligned at 1 second beacon intervals.

Applicable standards can require synchronization of alarm notifications generated by a plurality of alerting devices located in a particular facility. In this regard, synchronization pulses 400 can be useful for coordinating certain types of alarm notifications. For example, an applicable standard may require that an alert signal includes a strobe which flashes at one second intervals. Similarly, some notification alarms can require an audible tone pulse at one second intervals. In such scenarios, the strobe and/or tone pulse generated at each alerting device $\mathbf{102}_1, \ldots \mathbf{102}_n$ can be coordinated based on the synchronization pulses 400. But it can be challenging to coordinate certain other types of alarm notifications due to a particular type of alarm notification that is required. The synchronization problem can be especially challenging to resolve in the case of those relatively long duration temporal pattern alerts which extend for arbitrary periods of time which are longer than the duration between synchronization pulses 400. The problem is compounded for asymmetrical temporal alert patterns which comprise a time varying duty cycle of on and off notification pulses. So a synchronization pulse as described herein is not sufficient to synchronize a non-symmetrical multi-second tonal pattern.

Figure 5A:
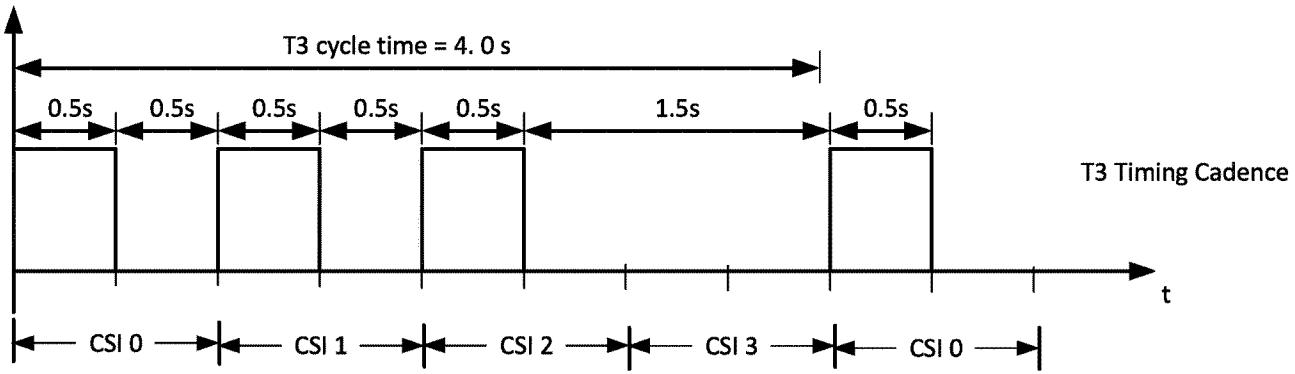
FIGS. 5A and 5B are a set of drawings that are useful for understanding various types of exemplary timing cadences which can be used in an alerting system according to an applicable standard.
Figure 5B:
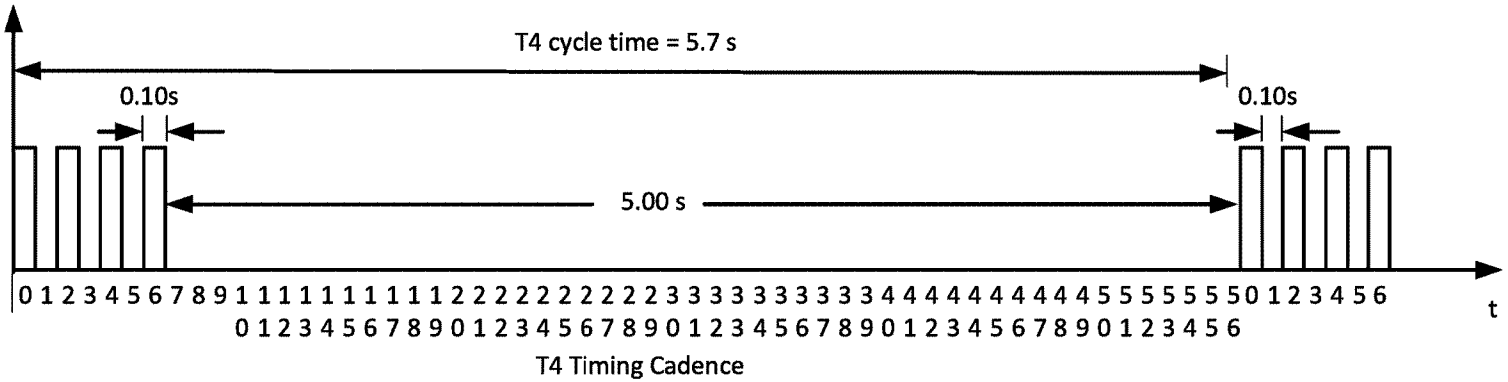

For example, a standard evacuation pattern can include a conventional Temporal-Three alarm (T3) comprised of an interrupted four count (three half-second pulses, followed by a one and one half second pause, repeated for the duration of the alarm condition or until silenced by an authorized user. The T3 alarm cadence is illustrated in FIG. 5A which shows that an alerting signal will transition between an "on" state in which the alert signal is active (e.g. tone is sounded and/or lamp is lighted) and an "off" state in which the alert signal is inactive (tone is silent and/or lamp is dark). Note that the T3 cycle time is a total of 4.0 s. FIG. 5B shows another exemplary type of temporal pattern. The temporal pattern shown in FIG. 5B is Temporal-Four (T4) and is commonly specified for use in alerting devices upon detection of carbon monoxide. As may be observed in FIG. 5B, the T4 pattern consists of four 0.10 s duration pulses, each spaced apart by 0.10 s, followed by a five-second silent period, that repeats for at least four minutes and then once a minute for the duration of the alarm condition or until silenced by an authorized user. The total T4 cycle time is 5.7 s.

Accordingly, in some embodiments, the alarm type 306 contained within the beacon message 300 can specify whether a notification unit in an alerting device $\mathbf{102}_1, \ldots \mathbf{102}_n$ should generate a T3 alarm cadence or a T4 alarm cadence. Of course, other types of alarm cadences could also be specified by the alarm type 306. In this regard, T3 and T4 are merely presented as two possible cadences which could be generated by the alerting devices.

In order to synchronize non-symmetrical multi-second tonal cadence patterns such as T3 and T4, each of the alerting devices $\mathbf{102}_1, \ldots \mathbf{102}_n$ advantageously performs certain synchronization operations. The synchronization operations ensure that precise synchronization of such cadence patterns occur quickly and efficiently. Referring once again to FIG. 3, the beacon message 300 can advantageously include a Cadence Section Indicator (CSI) 308. The CSI will specify a numerical value which can be used to synchronize alert patterns comprising temporal cadences. More particularly, the CSI indicates which portion of the temporal alarm pattern to sound/emit beginning at the next synchronization pulse.

The value range of the CSI 308 is advantageously selected to have sufficient granularity so that it can uniquely indicate or specify each portion of each cadence the alerting devices will be required to reproduce. As an example, consider a scenario as described herein with respect to FIGS. 1-5, where T3 and T4 type cadences may need to be synchronized, depending upon the alarm condition. It may be observed in that only four CSI values are needed to specify the different parts of a T3 cadence in accordance with a is beacon interval. These parts are indicated in FIG. 5A as CSI 0, CSI 1, CSI 2, CSI 3. In contrast, FIG. 5B shows that 57 CSI values are needed to specify the different parts of each T4 cadence. We seek a value range of CSI 308 which has sufficient granularity for representing both cadence types.

As a first step, a duration of time is selected which (1) represents an even number of beacon intervals, and (2) represents an integer number of each of the possible cadence cycles which may need to be synchronized. This duration of time shall be referred to herein as sequence duration $T_{sd}$. So as an example, if only two cadences are to be synchronized and the beacon interval is 1 second, then we seek a sequence duration $T_{sd}$ which is an integer number of seconds, and where $T_{sd}$=n (cycle time of cadence 1)=m (cycle time of cadence 2), where n and m are both represent an integer number of cadence cycles.

Figure 6:
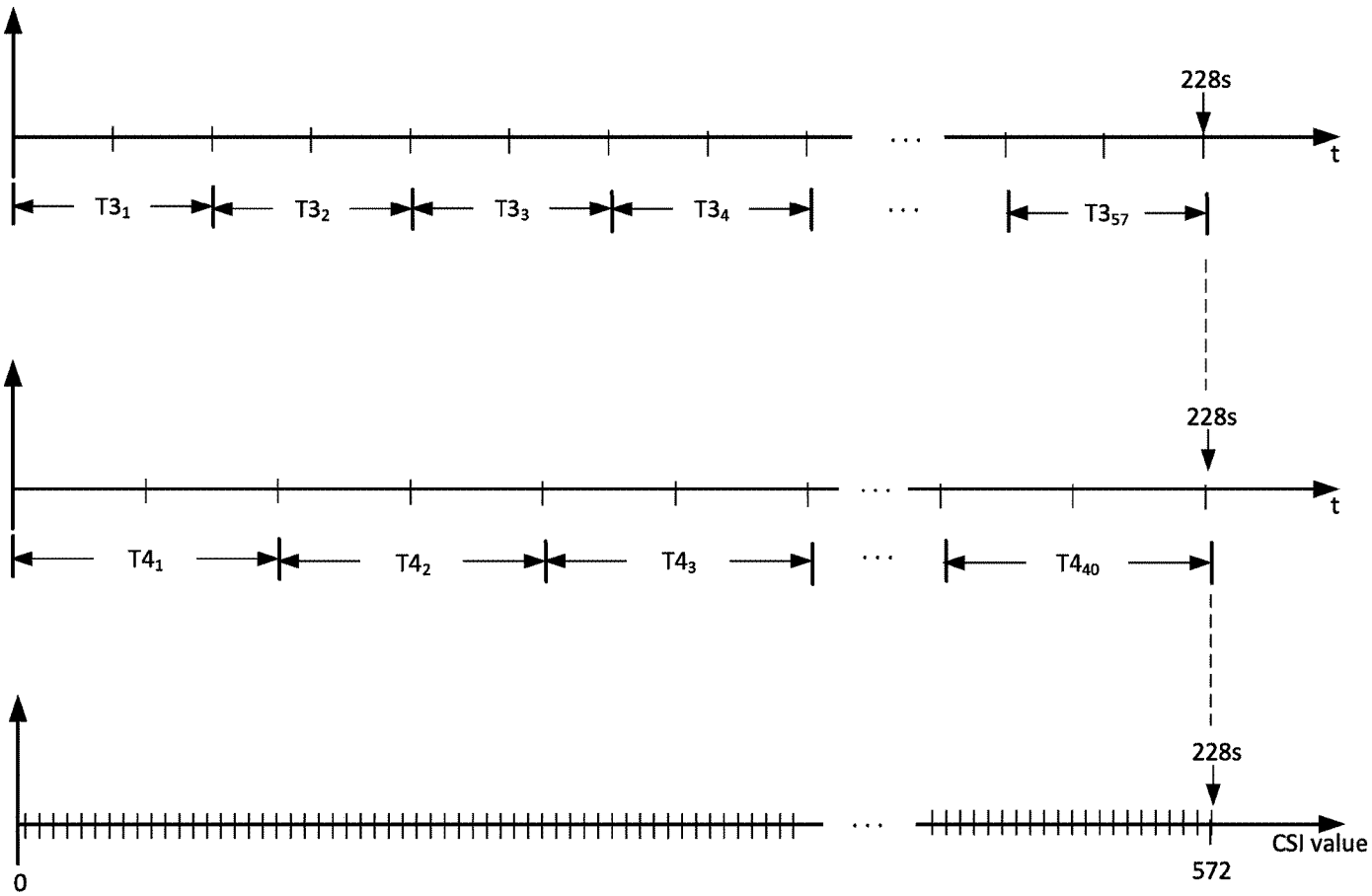
FIG. 6 is a timing diagram that is useful for understanding how a suitable sequence duration can be selected for a plurality of different alarm cadences.

As an example, consider a scenario in which cadence 1 is selected to be T4 and cadence 2 is selected to be T3. The T4 cadence has a cycle time which is 5.7 s in total duration, whereas the duration of the cycle time for T3 cadence is 4 s. To arrive at an appropriate value of $T_{sd}$ we begin by multiplying the 5.7 second T4 cycle time by a factor of ten to obtain an integer number of T4 cycles corresponding to a whole number of seconds (5.7 s×10=57 seconds). But a 57 second sequence duration would not be divisible by 4 (corresponding to the duration in seconds of a T3 cadence). So we multiply 57 times 4 to obtain a sequence duration $T_{sd}$=228 s. Note that in this example $T_{sd}$=228 s=57 (cycle time of cadence T3)=40 (cycle time of cadence T4). FIG. 6 illustrates this concept and shows that that this 228 s period can include 57 T3 cadence cycles or 40 of the T4 cadence cycles.

Continuing with the example, assume that the actual duration of each slot (Slot 0, . . . Slot 3) is 398.4375 ms. This means that over the 228 s sequence duration Tad, the communication protocol will transition through a total of approximately 572 time slots since 228 s/0.3984375 s/slot=572.235294 slots. In order to represent what portion of the T3 or T4 cadence should be sounded in any slot during the 228 s interval we must be able to represent 572 cadence parts corresponding to the duration of $T_{sd}$. Accordingly, we can choose to use a CSI value range of 1 to 572 in the beacon message. In this regard it may be noted that the CSI value will inform the alerting device which one of the 572 parts of the sequence it should begin sounding at the beginning of the next synchronization pulse; and that this sequence range will be suitable for any cadence that has a cycle time of 1, 2, 4 or (5.7*10) seconds. The relationship between the CSI value and the T3 and T4 cadences is illustrated in FIG. 6. Note that the zero time in FIG. 6 can correspond to an arbitrary first synchronization pulse received by a particular alerting device from a parent device.

In the foregoing calculations where we determine that 228 s/0.3984375 s/slot=572.235294, one can ignore the remainder of 0.235294 as this only represents 93.75 ms out of the 398.4375 ms and as a percentage of the 228 s interval, 93.75 ms is (0.09375/228)*100=0.04111%. Also after 255 hops the 1.5625 ms remainder adds up to exactly one hop. This jitter can be handled by synchronization math that keeps the one second timer synchronized across multiple RF devices. The foregoing calculations are presented simply to demonstrate that the number of channels and hop times can be mathematically manipulated to derive an appropriate CSI range.

So assuming that an alerting device $\mathbf{102}_1$, . . . $\mathbf{102}_n$ determines the slot count and CSI value, it can then pass enough information at any portion of the alarm cycle to an attached notification unit so as to allow the notification unit to indicate/sound the proper cadence synchronized to other alerting devices.

Figure 7:
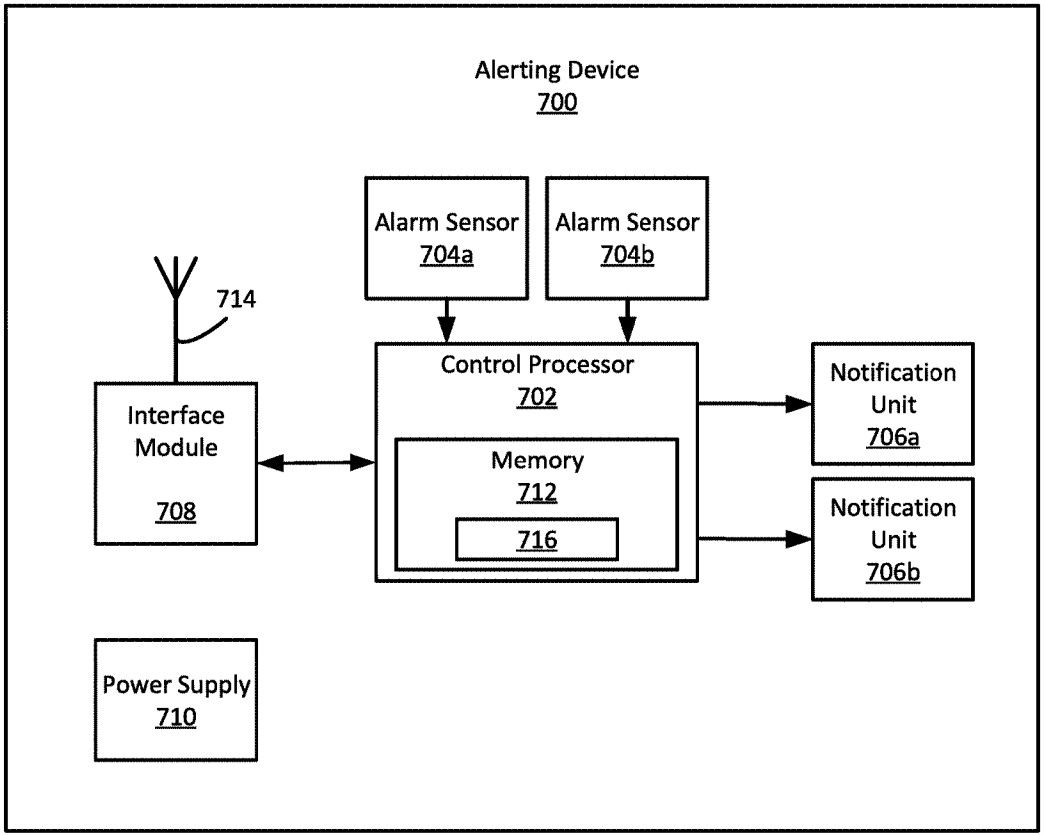
FIG. 7 is a simplified block diagram of an embodiment alerting device which can carry out the alerting and synchronization operations described herein.

Turning now to FIG. 7 there is shown a block diagram of an alerting device 700 which is exemplary of alerting devices $\mathbf{102}_1$, $\mathbf{102}_2$, $\mathbf{102}_3$, $\mathbf{102}_4$, . . . $\mathbf{102}_n$. The parent device 104 can have a hardware configuration similar to the alerting devices.

As illustrated in FIG. 7, the alerting device 700 can comprise several interconnected modules including a control processor 702, one or more alarm sensors 704*a*, 704*b* (or no alarm sensors in scenarios where separate alarm detection devices are provided), one or more notification units 706*a*, 706*b*, and an interface module 708. The alerting device can also include a power supply 710. The power supply can include a battery and/or a circuit capable of providing the necessary electrical power to operate the alerting device 700 based on utility wiring provided in the facility. In order to avoid obscuring the embodiments, connections between the power supply and the other modules in alerting device 700 are not shown.

The control processor 702 can comprise one or more components such as a processor, an application specific circuit, a programmable logic device, a digital signal processor, or other circuit programmed to perform the functions described herein. The control processor 702 can include a set of instructions 716 which are stored in a data store or memory 712. The set of instructions 716 can be used to cause the control processor 702 to perform any one or more of the methodologies discussed herein.

The interface module 708 can be comprised of hardware components (electronic circuitry) and/or software/firmware to facilitate wired or wireless data communications with other alerting devices 700 in accordance with a suitable communication protocol. According to some embodiments, the interface module 708 can comprise an RF transceiver including an antenna 714, wherein the RF transceiver operates in accordance with a spread spectrum communication protocol.

Alarm sensors 704*a*, 704*b* comprising sensing transducers and/or electronic circuits which are designed to detect the presence of an alert condition. For example, the alarm sensors 704*a*, 704*b* can comprise smoke sensors or heat sensors for detecting the presence of fire. Alternatively, one or more of the alarm sensors can be designed to detect the presence of certain hazardous chemical compounds, such as carbon monoxide. Of course, many types of sensor are possible and the embodiments are not intended to be limited to those specific hazardous conditions and/or substances described here.

Notification units 706*a*, 706*b* can comprise any device capable of generating a perceptible alert signal. For example, a notification unit 706*a* as described herein can be adapted to generate an audible tone. Such devices can comprise a tone generator, an audio signal driver circuit, and a loudspeaker (not shown). A notification unit 706*b* can be adapted to generate a visible alert signal using a strobe or lamp, and a lamp driver circuit (not shown).

Some embodiment alerting devices may implement functions of certain modules in two or more interconnected hardware modules or devices with related control and data signals communicated between and through the modules, or as portions of an application-specific integrated circuit. Thus, the exemplary alerting device 700 is applicable to software, firmware, and hardware implementations.

Figure 8:
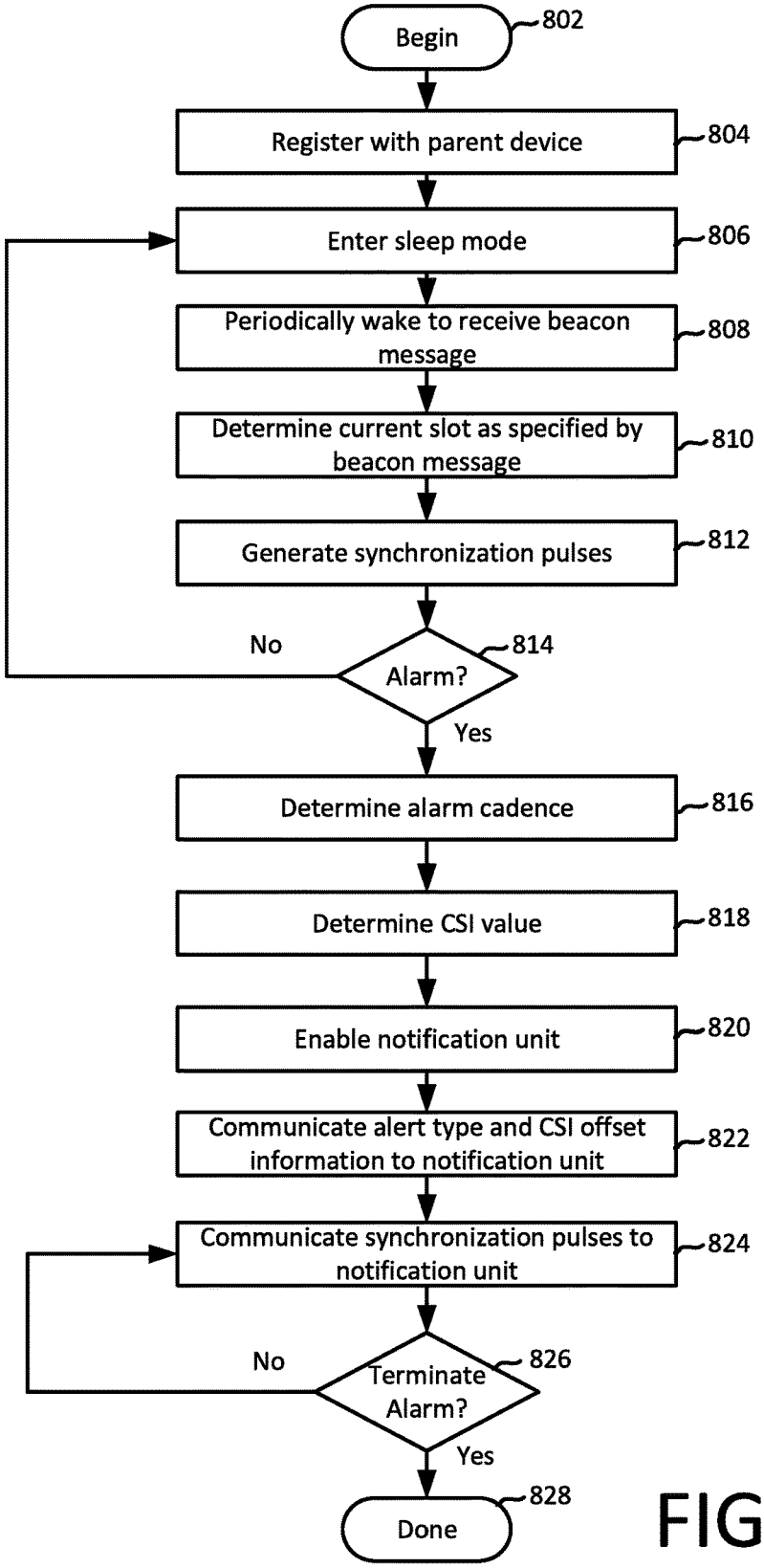
FIG. 8 is a flowchart that is useful for understanding a cadence synchronization process disclosed herein.

Turning now to FIG. 8, a process for synchronizing a cadence can begin at 802 and continue to 804 where an alerting device registers with a parent device, after which it enters a sleep mode at 806. One or more of the operations shown in FIG. 8 can be performed under the supervision of a processing unit, such as control processor 702.

The alerting device will periodically wake at 808 to receive a beacon message 300 from the parent device. For example, the alerting device may wake every 1.6 seconds. Once awake, the alerting device will use the slot count information (e.g., slot count 302) to determine a current slot at 810 as specified by the beacon message. The alerting device will also generate synchronization pulses at 812. For example, the synchronization pulses can be at 1 second intervals as described herein. The timing of the synchronization pulses can be derived from the slot count so that the synchronization pulses are synchronously generated at each of the alerting devices.

At 814 the alerting device can determine whether the beacon message indicates an alarm condition (e.g. a hazardous condition requiring that an audible and/or visible warning notification). For example, such condition can be specified by the alarm status 304 part of the beacon message. If no alarm condition is specified, the alerting device can return to sleep mode at 806. However, if an active alarm condition exists (814: Yes), then the process continues on to 816 where the alerting device parses the beacon message 300 to determine an alarm cadence which is specified (e.g., a cadence as specified by alarm type 306). The alerting device also parses the beacon message to determine a CSI value at 818.

Figure 9:
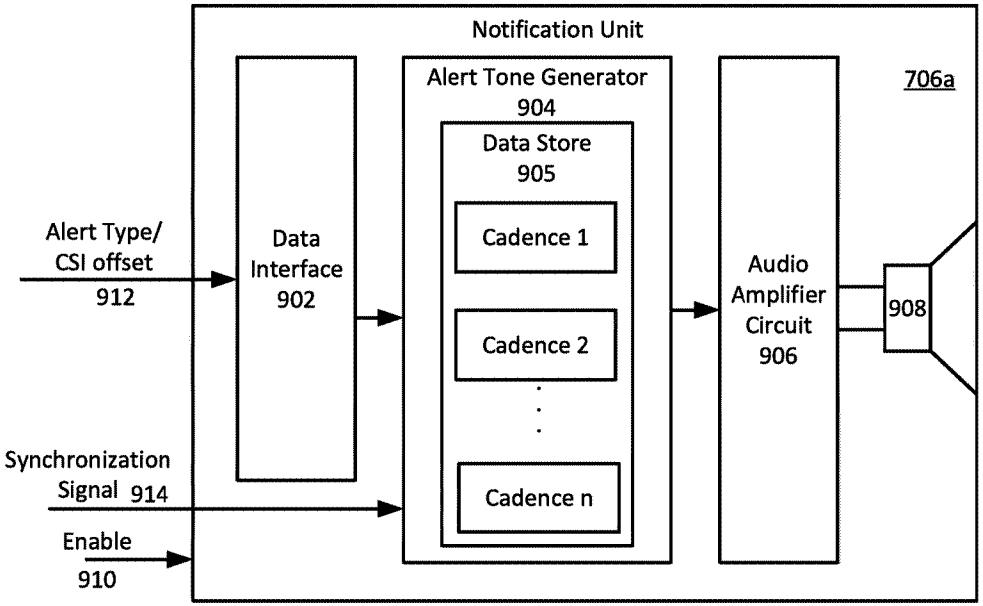
FIG. 9 is a block diagram that is useful for understanding certain aspects of a notification unit disclosed herein.

In the event of an active alarm condition, the alerting device can communicate certain information to the notification unit. At 820 an enable signal is communicated to power up the device and prepare it for generating an alarm tone. This concept is illustrated in FIG. 9 which shows exemplary notification unit 706*a* receives an enable signal 910. The alerting device will also communicate the alert type and CSI offset information 912 to the notification unit at 822. For example, this information can be communicated as a serial message to a data interface 902 in the notification unit. Further, at 824 the alerting device can communicate to the notification unit a synchronization signal 914 generated by the alerting device.

The CSI offset information communicated to the notification unit could be the same as the value specified by the CSI contained in the beacon message (e.g., a value having a range between 1 and 572). However, it may be convenient to simplify the information communicated to the notification unit. For example, in the case of the T3 cadence a value of between 0 and 3 could be communicated to specify one of four parts of the T3 cadence. Similarly, in the case of a T4 cadence, a CSI offset value of between 0 and 56 could be communicated to the notification unit. This simplification operation can be performed by control processor 702 so that the CSI offset value actually communicated to the notification unit pertains to an offset for a single cadence cycle (e.g. a value between 0 and 56 in the case of T4 cadence, or a value between 1 and 3 for a T3 cadence). In other scenarios, these simplification operations can be performed at the notification unit.

The CSI offset information can be specified using serial data as described above. However, embodiments are not limited in this regard and other methods can also be used for communicating CSI offset information to the notification unit if serial communications are not available. So the exact method of communicating this data to the notification unit can depend in part on the arrangement of the alerting device and the notification unit. For example, in some embodiments pulse width modulation can be used to specify CSI offset information by varying a width of a pulse, (e.g. a synchronization pulse) that is communicated to the notification unit. A data interface of the notification unit can decode the pulse width information to determine which part of a cadence cycle to sound. As an example, a 10 ms duration pulse could indicate to the notification unit to sound the 4 pulses associated with a T4 cadence. A 20 ms pulse could indicate a 500 ms tone associated with a T3 cadence. A 30 ms pulse could indicate one second of silence.

Figure 10:
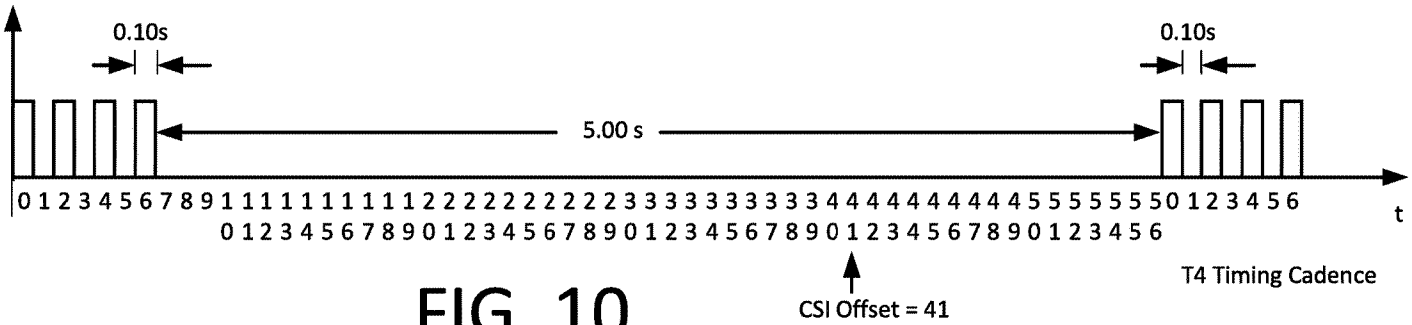
FIG. 10 is a timing diagram of an exemplary T4 type cadence showing how a CSI offset value is used to synchronize an output of an alerting device with other alerting devices in an alerting system.

Once the notification unit has received the enable signal, alert type, CSI offset and synchronization signal, it will begin generating the specified alarm cadence at the occurrence of the next synchronization pulse. For example, with reference to FIGS. 9 and 10, assume that the alert type is T4 and CSI offset value communicated to the notification unit is 41. In such a scenario, an alert tone generator 904 in the notification unit will access stored cadence information contained in data store 905. Upon the occurrence of the next synchronization pulse, the alert tone generator will begin reproducing the specified cadence (T4 in this example). However, rather than reproducing such cadence from the beginning it will begin the reproduction process at CSI offset 41. As shown in FIG. 9, CSI offset value 41 corresponds to a silent portion of the cadence. So the alert tone generator will generate a remainder of the current T4 cadence cycle starting at CSI offset 41 (which in this example would be a silent period) in synchronization with other alerting units operating in a similar manner, and would thereafter continue to generate each succeeding cycle of the T4 cadence in synchronization with the other alerting units $\mathbf{102}_1, \ldots \mathbf{102}_n$. As shown in FIG. 9, the output of the alert tone generator 904 can be communicated to an audio amplifier or horn driver circuit 906 before being communicated to a loudspeaker 908.

In scenarios where there is a specified time limit (e.g., 10 seconds) within which an alarm notification must be sounded after the detection of an alarm event, the notification unit can immediately sound a first portion of a cadence in order to meet the time limit requirements for notification and then synchronize the balance of the cadence on the first sync pulse. This would allow immediate notification and cadence synchronization to begin within the first second.

At some point in time, an alerting device $\mathbf{102}_1, \ldots \mathbf{102}_n$ can receive a beacon message which specifies that an alarm should be terminated. If so (826: Yes), then the process can terminate at 828 or continue with other operations (e.g., return to a sleep mode).

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Although the embodiments have been illustrated and described with respect to one or more implementations, equivalent alterations and modifications will occur to others skilled in the art upon the reading and understanding of this specification and the annexed drawings. In addition, while a particular feature of an embodiment may have been disclosed with respect to only one of several implementations, such feature may be combined with one or more other features of the other implementations as may be desired and advantageous for any given or particular application. Thus, the breadth and scope of the embodiments disclosed herein should not be limited by any of the above described embodiments. Rather, the scope of the invention should be defined in accordance with the following claims and their equivalents.

We claim:

1. A method for synchronizing a non-symmetrical tonal pattern in a wireless alerting system, comprising:

concurrently receiving at a plurality of alerting devices a beacon message that is wirelessly broadcast by a parent device of the alerting devices during each of a plurality of time slots defined by a communication protocol;

synchronously generating at each of the plurality of alerting devices a synchronization pulse signal comprised of a plurality of synchronization pulses which are periodic in accordance with a predetermined synchronization pulse interval;

receiving as part of the beacon message a cadence section indicator (CSI) specifying a value indicating a portion of each alarm cadence of a plurality of different alarm cadences that the plurality of alerting devices is able to reproduce; and using the value specified by the CSI in combination with the synchronization pulse signal to determine a portion of an alarm cadence of the plurality of different alarm cadences to sound at each of the plurality of alerting devices so that the alarm cadence is synchronized among the plurality of the alerting devices.

2. The method according to claim 1, wherein the alarm cadence is a non-symmetrical tonal pattern extending for a duration of time that exceeds the duration of the predetermined synchronization pulse interval.

3. The method according to claim 1, further comprising specifying in the beacon message one of the plurality of different alarm cadences, each having a non-symmetrical tonal pattern.

4. A method for synchronizing a non-symmetrical tonal pattern in a wireless alerting system, comprising:

concurrently receiving at a plurality of alerting devices a beacon message that is wirelessly broadcast by a parent device of the alerting devices during each of a plurality of time slots defined by a communication protocol;

synchronously generating at each of the plurality of alerting devices a synchronization pulse signal comprised of a plurality of synchronization pulses which are periodic in accordance with a predetermined synchronization pulse interval;

receiving as part of the beacon message a cadence section indicator (CSI) specifying a value;

using the value specified by the CSI in combination with the synchronization pulse signal to determine a portion of an alarm cadence to sound at each of the alerting device so that the alarm cadence is synchronized among the plurality of the alerting devices;

specifying in the beacon message one of a plurality of different alarm cadences, each having a non-symmetrical tonal pattern; and selecting a range of the CSI to specify the portion of the alarm cadence for each of the plurality of different alarm cadences.

5. The method according to claim 4, further comprising selecting a range of the CSI value to comprise an integer multiple of the number of cadence parts in each of the plurality of different alarm cadences.

6. The method according to claim 1, further comprising deriving a synchronous timing of the plurality of synchronization pulses at each of the plurality of alerting devices based on information contained in the beacon message.

7. The method according to claim 6, further comprising deriving the synchronous timing from a slot count information contained in the beacon message, where the slot count information specifies one of a plurality of predetermined time slots which are defined as part of the communication protocol.

8. The method according to claim 5, further comprising deriving the synchronous timing from a known data structure of each of said plurality of time slots.

9. The method according to claim 1, further comprising using a notification unit at each of the plurality of alerting devices to synchronously sound the alarm cadence at each of the plurality of the alerting devices.

10. A wireless alerting device, comprising:

a wireless receiver configured to receive a beacon message that is wirelessly broadcast by a parent device during each of a plurality of time slots defined by a communication protocol;

a processing device configured to synchronously generate a synchronization pulse signal comprised of a plurality of synchronization pulses which are periodic in accordance with a predetermined synchronization pulse interval;

parse the beacon message to determine a cadence section indicator (CSI) contained therein specifying a value indicating a portion of each alarm cadence of a plurality of different alarm cadences that a plurality of alerting devices is able to reproduce; and use the value specified by the CSI in combination with the synchronization pulse signal to determine a portion of an alarm cadence of the plurality of different alarm cadences to sound at the wireless alerting device so that the alarm cadence is synchronized with an alarm cadence sounded in at least a second alerting devices which also receives the beacon message.

11. The wireless alerting device according to claim 10, wherein the alarm cadence is a non-symmetrical tonal pattern extending for a duration of time that exceeds the duration of the predetermined synchronization pulse interval.

12. The wireless alerting device according to claim 10, wherein the beacon message specifies one of the plurality of different alarm cadences, each having a non-symmetrical tonal pattern.

13. A wireless alerting device, comprising:

a wireless receiver configured to receive a beacon message that is wirelessly broadcast by a parent device during each of a plurality of time slots defined by a communication protocol;

a processing device configured to synchronously generate a synchronization pulse signal comprised of a plurality of synchronization pulses which are periodic in accordance with a predetermined synchronization pulse interval;

parse the beacon message to determine a cadence section indicator (CSI) contained therein specifying a value; and use the value specified by the CSI in combination with the synchronization pulse signal to determine a portion of an alarm cadence to sound at the wireless alerting device so that the alarm cadence is synchronized with an alarm cadence sounded in at least a second alerting devices which also receives the beacon message;

wherein the beacon message specifies one of a plurality of different alarm cadences, each having a non-symmetrical tonal pattern; and wherein the CSI has a predetermined value range to specify the portion of the alarm cadence for each of the plurality of different alarm cadences.

14. The wireless alerting device according to claim 13, wherein the CSI has a predetermined value range comprised of an integer multiple of the number of cadence parts in each of the plurality of different alarm cadences.

15. The wireless alerting device according to claim 10, wherein the processing device is further configured to derive a synchronous timing of the plurality of synchronization pulses at each of the plurality of alerting devices based on information contained in the beacon message.

16. The wireless alerting device according to claim 15, wherein the processing device is further configured to derive the synchronous timing from a slot count information contained in the beacon message, where the slot count information specifies one of a plurality of predetermined time slots which are defined as part of the communication protocol.

17. The wireless alerting device according to claim 14, wherein the processing device is further configured to derive the synchronous timing from a known data structure of each of said plurality of time slots.

18. The wireless alerting device according to claim 10, further comprising a notification unit responsive to the processing device and configured to synchronously sound the alarm cadence at each of the plurality of the alerting devices.

19. A wireless alerting system, comprising:

a plurality of wireless alerting devices each including a wireless receiver configured to concurrently receive a beacon message that is wirelessly broadcast by a parent device during each of a plurality of time slots defined by a communication protocol;

a processing device configured to synchronously generate a synchronization pulse signal comprised of a plurality of synchronization pulses which are periodic in accordance with a predetermined synchronization pulse interval;

parse the beacon message to determine a cadence section indicator (CSI) contained therein specifying a value indicating a portion of each alarm cadence of a plurality of different alarm cadences that the plurality of wireless alerting devices is able to reproduce; and use the value specified by the CSI in combination with the synchronization pulse signal to determine a portion of an alarm cadence of the plurality of different alarm cadences to sound at the wireless alerting device so that the alarm cadence is synchronized with an alarm cadence sounded in the plurality of alerting devices; and a notification device responsive to the processing device to synchronously sound the alarm cadence.

* * * * *